United States Patent [19]

Guttinger et al.

[11] Patent Number: 4,975,684

[45] Date of Patent: Dec. 4, 1990

[54] FIRE DETECTING SYSTEM

[75] Inventors: Hannes Guttinger, Stafa; Mark Jaggi, Schlieren, both of Switzerland

[73] Assignee: Cerberus AG, Switzerland

[21] Appl. No.: 364,807

[22] Filed: Jun. 9, 1989

[30] Foreign Application Priority Data

Jun. 10, 1988 [CH] Switzerland ..... 2242/88

[51] Int. Cl.[5] ..... G08B 17/00

[52] U.S. Cl. ..... 340/587; 340/522; 340/567; 340/629

[58] Field of Search ..... 340/587, 522, 573, 565-567, 340/628-630; 250/342

[56] References Cited

U.S. PATENT DOCUMENTS

| | | | |
|---|---|---|---|
| Re. 28,915 | 7/1976 | Ogden et al. | 340/507 |
| 3,548,205 | 12/1970 | Ogden | 307/517 |
| 3,594,751 | 7/1971 | Ogden et al. | 340/509 |
| 3,611,335 | 10/1971 | Ogden et al. | 340/522 |
| 3,713,128 | 1/1973 | Wong et al. | 340/566 X |
| 3,838,408 | 9/1974 | McMaster | 340/541 X |
| 4,195,234 | 3/1980 | Berman | 340/567 X |
| 4,313,110 | 1/1982 | Subulak et al. | 340/527 |
| 4,319,231 | 3/1982 | Maruyama et al. | 340/587 |
| 4,388,616 | 6/1983 | Machida | 340/587 |
| 4,390,869 | 6/1983 | Christen et al. | 340/632 |
| 4,437,089 | 3/1984 | Achard | 340/541 |
| 4,514,729 | 4/1985 | Szarka | 340/825.06 |
| 4,691,196 | 9/1987 | Kern et al. | 340/578 |
| 4,709,330 | 11/1987 | Yokoi et al. | 340/573 X |
| 4,792,797 | 12/1988 | Tanguay et al. | 340/628 |
| 4,814,748 | 3/1989 | Todd | 340/628 X |
| 4,871,999 | 10/1989 | Ishii et al. | 340/587 |

FOREIGN PATENT DOCUMENTS

| | | |
|---|---|---|
| 0076338 | 4/1983 | European Pat. Off. . |
| 0122433 | 10/1984 | European Pat. Off. . |
| 2485773 | 6/1980 | France . |
| 506147 | 5/1971 | Switzerland . |
| 572252 | 1/1976 | Switzerland . |
| 629905 | 5/1982 | Switzerland . |
| 1485790 | 9/1977 | United Kingdom . |
| 1486535 | 9/1977 | United Kingdom . |
| 2043977 | 10/1980 | United Kingdom . |

*Primary Examiner*—Glen R. Swann, III
*Assistant Examiner*—Thomas J. Mullen, Jr.
*Attorney, Agent, or Firm*—Brumbaugh, Graves, Donohue & Raymond

[57] ABSTRACT

A fire detector having a first sensor for emitting a first output signal in response to a fire phenomenon, a second sensor for detecting a source of false alarm conditions generated by man and/or machinery and an evaluating circuit. The evaluating circuit has a mechanism for activating an alarm signal when the value of the output of the first sensor exceeds a threshold value. The threshold value is set by the second sensor in response to the detection of signals generated during normal use of the premises to be protected.

11 Claims, 1 Drawing Sheet

FIRE DETECTING SYSTEM

The present invention relates to a novel fire detection system which effectively reduces the instances of false alarms attributable to benign fire phenomena resulting from, inter alia, human activities such as cigarette, pipe or cigar smoking. More specifically, the fire detection system of the present invention combines at least one fire detector with at least one means for detecting the source of benign fire phenomena, e.g., an acoustical or infrared detector, hereinafter referred to as an acoustical detector. The acoustical detector is connected to the fire detector and adapts the sensitivity of the fire detector to the environment in which it is located.

BACKGROUND OF THE INVENTION

Fire detection systems comprising a fire detector or a plurality of fire detectors having different response thresholds are generally well-known in the art. They comprise fire sensor elements which generate an output signal in response to fire or fire-related phenomena and evaluating circuit elements having a threshold detector with a predetermined threshold value which thereby establishes the sensitivity of the detection system. When the output signal from the sensor exceeds a predetermined threshold value, an alarm signal is generated. In order to detect fires in their earliest stage, fire detectors generally rely upon the use of a threshold detector with a low threshold value. Nevertheless, systems utilizing fire detectors with low threshold values (high sensitivity) have the drawback that a fire alarm will be activated in response to benign fire phenomena even of short duration.

To remedy this drawback, Swiss patent No. 629,905 discloses a fire and/or gas sensing and signaling system wherein the signaling portion of the system has a warning indicator and an alarm indicator. The warning indicator provides a warning output if fire phenomena above a first, lower threshold is sensed by the detector. An alarm indicator provides an alarm output if the fire phenomena sensed by the detector exceeds a second and higher threshold. The signalling system may further comprise timing stages which start a timing interval upon sensing fire phenomena above the first and lower warning threshold value. If the warning signal above the first threshold level persists for the duration of a time interval predetermined by the timing stage, that signal will lock-in and be indicated in the control panel. If the fire phenomena sensed by the detector exceeds the second, higher threshold level, an alarm signal will be activated. Timing stages, although shorter than those for the warning signal, may be used in connection with the alarm signal. The objective of such a prior art system is to be able to distinguish positively between a fire condition lasting for only a short time and genuine fire condition necessitating an alarm.

British patent No. A 2,043,977 discloses a fire detection system which detects different types of fires, e.g. fires involving flammable liquids and smoldering fires. In this detection system, sensor elements which respond to various different kinds of fire phenomena are combined using an "OR-logic" in the evaluating circuit. These systems, however, are particularly prone to false alarms.

Fire detection systems are also known which utilize a combination of sensor elements with an "AND-logic". See for example Swiss patent No. A 506,147. These systems however reduce the overall sensitivity of detection since an alarm signal is only generated if both sensor elements respond simultaneously. Swiss patent No. 572,252 sought to remedy this drawback, however, by designing the electronic evaluating circuit in such a way that the fire sensitivity of one sensor would be increased if the other fire sensor is activated by a fire phenomena. European Patent No. A 0,076,338 discloses similar evaluating circuitry for a fire detection system.

Although it would seem a simple matter to reduce the sensitivity of the fire detectors in a system and thereby reduce the incidence of false alarms, this is not an acceptable solution since doing so defeats the primary purpose of effective early detection of fire conditions. Accordingly, the object of the present invention is to provide a fire detection system that avoids the drawbacks of false alarms as well as the drawbacks of the prior art systems which have sought to minimize the incidence of false alarms, without simultaneously reducing the sensitivity of the fire detector.

SUMMARY OF THE INVENTION

Figure 1:
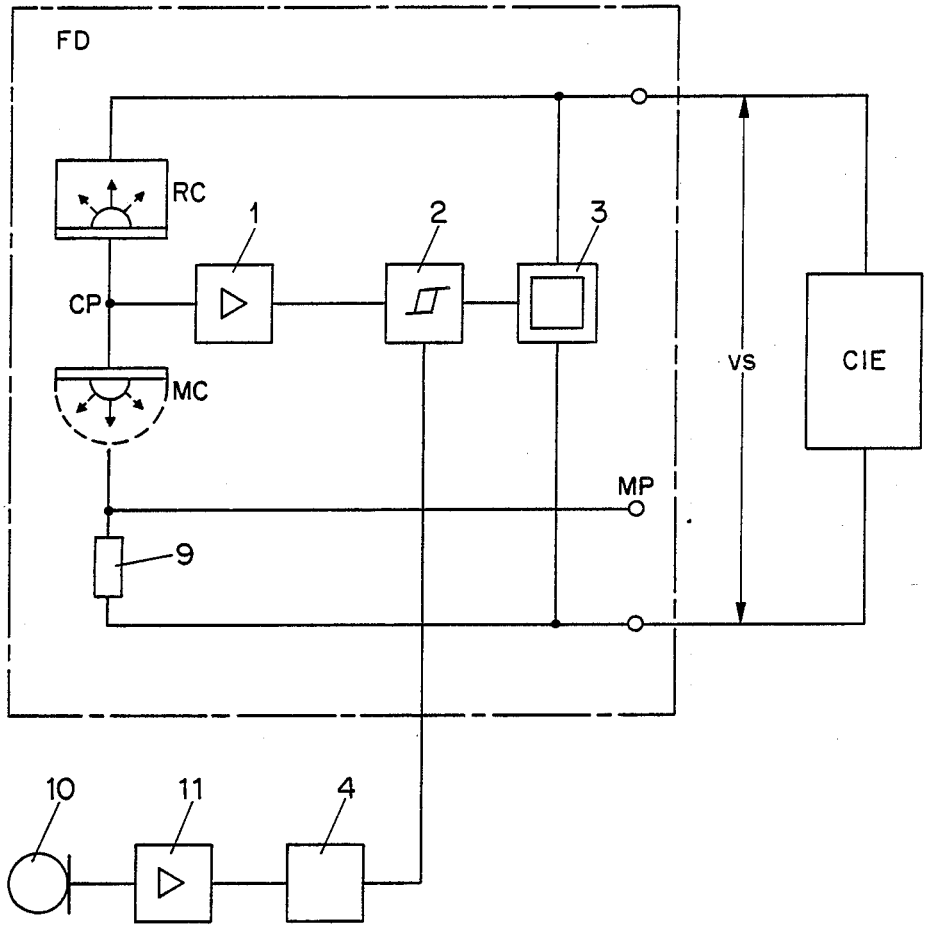
FIG. 1 is a block diagram of a fire detection system in accordance with the present invention.

The principal sources of benign fire phenomena generally involve the presence of man and machinery. Accordingly the present invention comprises a fire detection system having at least one first sensor for detecting fire conditions and at least one second sensor for detecting the source of benign fire phenomena and control and indicating equipment. The fire detector is in the form of a sensor which emits an electric signal in response to fire phenomena. Either the fire detector or the control and indicating equipment is provided with an electric evaluating circuit comprising a threshold detector or other suitable means such as an analog or digital evaluating circuit which emits an alarm signal when a predetermined threshold value is exceeded. The second sensor, which detects the presence of a source of benign fire phenomena, includes for example an acoustic sensor, such as a microphone. Infrared and motion detectors are alternatives to an acoustic detector. The output signal of the second sensor is amplified by a suitable means and forwarded to an evaluating circuit which has a switch that effects a change in the sensitivity of the fire sensor as a function of the output signal of the second sensor.

The fire detection system of the present invention is better adapted to its environment. For example, when the second sensor detects the presence of man or the operation of machinery in the space to be protected, the threshold value of the fire sensor is increased (sensitivity is lowered). When the second sensor no longer detects these conditions, the lower threshold value of the fire sensor is restored. Since many of the causes of false alarms can be traced to the activity of human beings, e.g. smoking, welding, painting, cooking as well as the operation of machinery that emits exhaust fumes, it has been found that with the reduction in fire sensitivity that is achieved as a function of the detection of man or machines, there is also achieved a considerable reduction in false alarms.

Accordingly, a fire detection system in accordance with the present invention provides the following advantages:

First in the absence of man and/or machinery the system automatically maintains a high sensitivity to fire phenomena. As such, the probability of false alarms is relatively low since the major sources for false alarms are not present.

Second, when the presence of man and/or machinery is detected, the sensitivity of the fire detectors is automatically lowered. However, the overall security provided by the system is not weakened because human beings are present and available to detect a fire in its earliest stage and moreover to differentiate between a real fire and a benign fire phenomenon thereby avoiding costly false alarms.

The application of the present invention of course is not limited to cases where man is the source of benign fire conditions. The second sensor can also be used to detect other sources which could produce false alarms, as for instance machinery producing steam or other exhaust fumes.

In general, it is the task of the sensor, whatever type is utilized, to adapt the sensitivity of the fire detector(s) to the environment which they are monitoring. In particular the sensor can be adapted to special trouble sources, e.g., where an acoustical sensor is used by frequency analysis of acoustical signals. In such a case only the noise of the false alarm source would cause a reduction of the sensitivity of the fire detectors installed in the vicinity of the source.

DETAILED DESCRIPTION OF THE INVENTION

The present invention will now be further described, by way of the illustrative, but non-limiting, block diagram of FIG. 1.

An ionization type smoke detector is represented as fire detector FD in combination with a microphone type acoustical sensor 10. The fire detector FD consists of a measuring chamber MC in which the air is made conductive by the use of a radioactive source such as Americium. The measuring chamber MC is connected in series with a reference chamber RC forming a voltage divider connected to the supply voltage VS by way of the adjusting resistor 9. The connection point of the two chambers, CP, is connected with an impedance converter 1 which provides an output signal for the threshold detector 2. If this output signal exceeds a certain predetermined value the threshold detector 2 triggers a switching circuit 3 which sends an alarm signal to the control and indicating equipment, CIE.

While the reference chamber RC is mechanically closed, the measuring chamber MC has openings to allow the surrounding air to enter. If combustion products enter the measuring chamber MC, the chamber current is reduced. The impedance of the measuring chamber MC is increased resulting in a voltage change at the connection point CP. If this voltage change exceeds a certain value determined by the threshold detector 2, the switching circuit 3 is triggered releasing an alarm.

If the acoustical sensor 10 detects noise, an electrical signal is generated, amplified by amplifier 11 and filtered by electrical filter 4. The filter permits for the analysis of the frequency spectrum of the noise resulting in an electrical signal which is characteristic of a certain trouble source. The electrical filter 4 is connected to the threshold detector 2 in such a way that the alarm threshold of the detector is controlled by the output signal transmitted by the electrical filter 4.

In accordance with the foregoing system the fire sensitivity of the fire detector is controlled by the presence of certain false alarm sources as for instance of a person smoking or the emission of fumes during the operation of a machine. Specifically, the output signal of the fire detector FD is influenced by applying a suitable voltage at MP so that the fire sensitivity of the fire detector FD adapts to its environment as for instance when man and/or machinery is present.

The specific example of a fire detection system described hereinabove is characterized by the fact that the components responsible for the combination of the fire signals with the signals from the acoustical sensor 10 are integrated in the fire detector FD. The acoustical sensor itself may be integrated in the fire detector FD or may be physically separated from the fire detector(s).

Preferred embodiments of the invention contemplated the use of an ionization chamber as fire sensor, the use of a microphone as acoustical sensor to control the fire sensitivity, and the integration of the acoustical sensor and the fire detector.

Another embodiment of the invention is provided where the acoustical sensor is not physically integrated in the fire detector.

The signal of the acoustical sensor may be used for the control of the fire sensitivity of one or more fire detectors. The fire detection systems can also be designed in such a way that more than one acoustical sensor is used to control the sensitivity of one fire detector. It is also possible that a plurality of acoustical sensors control a group of fire detectors. In another embodiment of the invention the components responsible for the change in the sensitivity of the fire detector are designed in such a way that they influence the output signal of the fire sensor. And in yet another embodiment of the novel fire detection system of the present invention, the components responsible for the change in the sensitivity of the fire detector are designed in such a way that they influence the alarm threshold of the fire detector.

While there are shown and described above various and preferred embodiments of the invention, it is to be expressly understood that the invention is not limited thereto, but may be modified in a variety of ways without departing from the scope of the present invention as disclosed and claimed herein. For instance the fire detector system of the invention may be constructed in such a way that the electrical circuit means for the combination of the output signals of the fire detector and of the acoustical sensor 10 are provided in the control and indicating equipment.

We claim:

1. A fire detector for protecting premises periodically occupied by workers and operating machinery, said fire detector comprising:

at least one first sensor for emitting a first output signal in response to a fire phenomenon, at least one second sensor for detecting a source of false alarm conditions, said false alarm conditions being detected from the presence and activities of said workers and operating machinery and an evaluating circuit, said evaluating circuit comprising means for providing an alarm signal in response to a value of said first output signal exceeding a threshold value and means for changing said threshold value relative to said first output signal value in response to a second output signal from said second sensor.

2. A fire detector according to claim 1, wherein the first sensor is selected from the group consisting of ionization-type sensors and optical-type sensors.

3. A fire detector according to claim 1, wherein the second sensor is selected from the group consisting of acoustic, infrared and motion sensors.

4. A fire detector according to claims 2 or 3 wherein the first sensor is an ionization type sensor and the second sensor is an acoustical type sensor.

5. A fire detector according to claim 2 wherein the first sensor is a diffused light smoke sensor.

6. A fire detector according to claim 1 wherein the evaluating circuit is integrated with the first sensor.

7. A fire detector according to claim 1 wherein the evaluating circuit is integrated with fire detection control and indicating equipment.

8. A fire detector according to claim 1 wherein the second sensor is integrated with the first sensor.

9. A fire detector according to claim 1 wherein the threshold value is changed by a switch means in the evaluating circuit.

10. A fire detector according to claim 9 wherein the means for providing an alarm signal comprises a threshold detector and the switch means changes the threshold detector value in response to said second output signal of said second sensor.

11. A fire detector according to claim 9 wherein the switch means changes the value of said first output signal relative to said threshold value.

* * * * *